US011185161B2

(12) United States Patent
Towe

(10) Patent No.: US 11,185,161 B2
(45) Date of Patent: Nov. 30, 2021

(54) SOFT CLOSE PRINT PAPER DRAWER

(71) Applicant: Toshiba TEC Kabushiki Kaisha, Shinagawa-ku (JP)

(72) Inventor: Brad W. Towe, Versailles, KY (US)

(73) Assignee: Toshiba TEC Kabushiki Kaisha, Shinagawa-ku (JP)

( * ) Notice: Subject to any disclaimer, the term of this patent is extended or adjusted under 35 U.S.C. 154(b) by 1 day.

(21) Appl. No.: 16/802,878

(22) Filed: Feb. 27, 2020

(65) Prior Publication Data

US 2021/0267369 A1 Sep. 2, 2021

(51) Int. Cl.
*A47B 88/467* (2017.01)
*A47B 88/47* (2017.01)

(52) U.S. Cl.
CPC ..... *A47B 88/467* (2017.01); *A47B 88/47* (2017.01)

(58) Field of Classification Search
CPC ... A47B 88/467; A47B 88/473; A47B 88/477; A47B 88/47; A47B 2210/175; A47B 2088/4675
See application file for complete search history.

(56) References Cited

U.S. PATENT DOCUMENTS 9,310,752 B2 * 4/2016 Hiura ..... G03G 15/6505
2006/0180996 A1 * 8/2006 Iwase ..... G03G 15/6502 271/162
2008/0191592 A1 * 8/2008 Dubach ..... E05B 65/46 312/319.1
2012/0326585 A1 * 12/2012 Dorsey ..... A47B 88/467 312/319.1
2014/0072248 A1 * 3/2014 Chen ..... A47B 88/47 384/20
2015/0108891 A1 * 4/2015 Brunnmayr ..... A47B 96/00 312/319.8
2016/0007748 A1 * 1/2016 Gasser ..... E05B 65/463 312/319.1
2017/0135479 A1 * 5/2017 Chen ..... F16D 11/16
2018/0160808 A1 * 6/2018 Wohlgenannt ..... E05F 1/16
2019/0086852 A1 * 3/2019 Goto ..... B65H 29/52

* cited by examiner

*Primary Examiner* — Hanh V Tran
(74) *Attorney, Agent, or Firm* — Ulmer & Berne LLP

(57) ABSTRACT

A printer paper drawer door closing mechanism includes a fixed chassis defining a chassis plane, a lever arm joined to the chassis and pivotable about a lever arm pivot axis from a first lever arm limit state to a second lever arm limit state. A first bearing surface extends from the lever arm at a first lever arm distance and a second bearing surface extending from the lever arm at a second lever arm distance. The first bearing surface is at a bearing surface distance from the second bearing surface. An energy storage element is integrated with the lever arm. A cam plate is translatable toward and away from the lever arm and pivotable about a cam plate pivot axis from a first cam limit state to a second cam limit state. The cam plate includes a first cam surface extending from the cam plate and a second cam surface extending from the cam plate, the first cam surface being oriented at a positive angle relative to the copier chassis plane and co-planar with the first bearing surface, the second cam surface is oriented at a negative angle relative to the copier chassis plane and co-planar with the second bearing surface. The distance separating the first bearing surface and the second bearing surface is substantially equal to the distance separating a distal end of the first cam surface and a proximal end of the second cam surface.

17 Claims, 13 Drawing Sheets

SOFT CLOSE PRINT PAPER DRAWER

TECHNICAL FIELD

This application relates generally to closing mechanisms for facilitating closing of drawers or doors. The application relates more particularly to a closing mechanism for facilitating the opening and closing of a drawer of a document processing device, such as a copier.

BACKGROUND

Document processing devices, including printers, copiers, scanners and multifunction peripherals (MFPs) or multifunction devices (MFDs), often utilize a drawer, or cassette, that holds a supply of paper, such as a stack of paper, for use in the document processing device. To replenish the supply of paper, the drawer can be opened, a new supply of paper can be installed, and the door closed. The opening and closing of the drawer is often achieved manually by a user, and difficulty in opening or closing the drawer can result in user frustration and/or unnecessary harm to the drawer or the document processing device due to excessive force causing drawer slamming, for example.

BRIEF DESCRIPTION OF THE DRAWINGS

Various embodiments will become better understood with regard to the following description, appended claims and accompanying drawings wherein:

DETAILED DESCRIPTION

The apparatuses, systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

The apparatuses, systems and methods disclosed herein relate to document processing devices including printers, copiers, scanners and multifunction peripherals (MFPs) or multifunction devices (MFDs) that utilize a sliding drawer, or cassette, that holds a supply of paper, such as a stack of paper. As used herein, MFPs are understood to comprise copiers or printers, alone or in combination with other of the afore-noted functions. It is further understood that any suitable document processing device is suitably used.

As noted above, user interaction with a sliding drawer of a document processing device can result in user frustration due to difficulty in properly sliding the drawer in or out. Additionally, user-induced force, whether inadvertent or due to perceived necessity, can cause the drawer to slam shut, thereby causing unnecessary wear and/or damage to the document processing device. Example embodiments herein provide an apparatus, system, and method for managing the closing of a drawer of a document processing device, facilitating a low-resistance soft close of the drawer, as well as a low-resistance opening of the drawer. Both of these advantages, as well as others disclosed herein, contribute to a more satisfactory user experience as well as a reduction in the damage to the document processing device.

Figure 1:
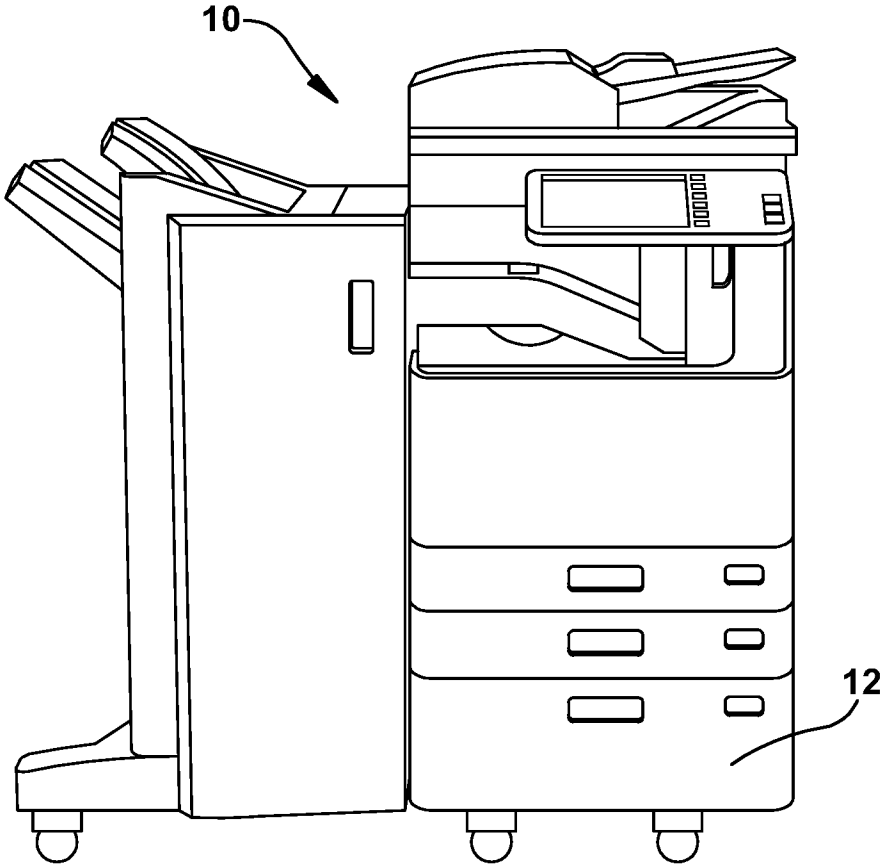
FIG. 1 is an example embodiment of document processing device.

In accordance with the subject application, FIG. 1 illustrates an example embodiment of a document processing device 10 that includes one or more drawers 12 for holding a supply of paper. The document processing device 10 is suitably a printer, copier, scanner, multifunction peripheral (MFPs) or a multifunction device (MFDs). The document processing device 10 can have a chassis that includes various slides, channels, and the like, in which mating elements of a drawer 12 are suitably operably engaged to permit the drawer to be drawn out of and urged into the document processing device 10. In general, any of known slides, bearings, catches, latches, and handles are suitably used with the example apparatuses, systems, and methods disclosed herein.

Figure 2:
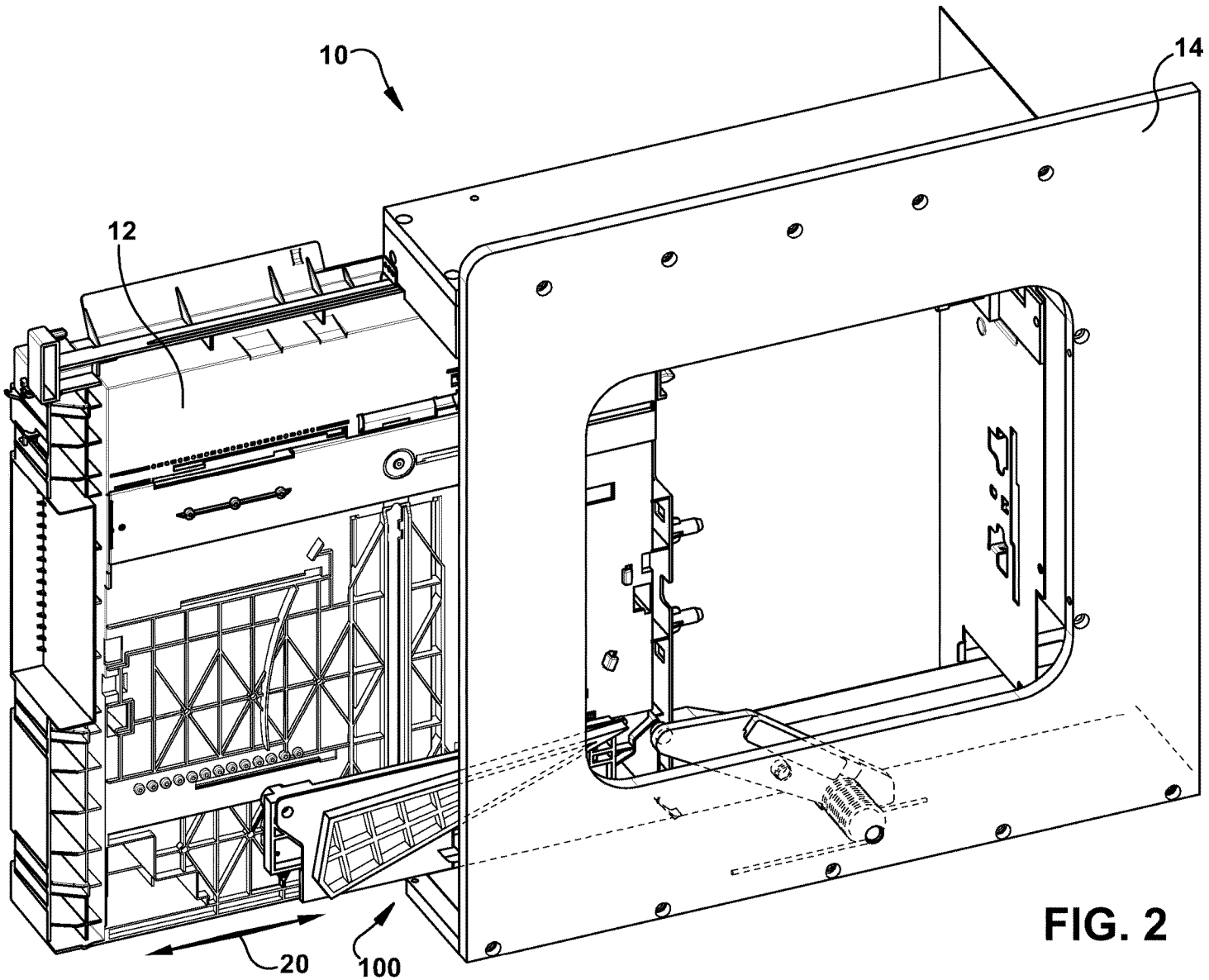
FIG. 2 is an example embodiment of a portion of a document processing device.

Turning now to FIG. 2, illustrated is a portion of a document processing device 10 illustrating the operational environment for an example embodiment of the closing mechanism 100 for facilitating the opening and closing of a drawer 12 of document processing device 10. As shown, a document processing device 10 can include a chassis 14 as a frame, on which and/or inside which the drawer 12 is mounted in a sliding or rolling configuration. The drawer 12 is suitably moved in and out of the document processing device 10 in the direction of the arrow 20, for example. The portion of the document processing device 10 shown by way of example in FIG. 2 is a perspective view of a portion of the document processing device 10 as would be found at the lower right of the document processing device shown in FIG. 1. For example, in FIG. 2 is shown a portion of the right side of a drawer 12 as it operably integrates with the right side of the chassis 14 of the document processing device 10, as viewed in FIG. 1. The closing mechanism 100 is disclosed herein in an embodiment in which it is operably integrated with the right side of a drawer 12, as shown in FIG. 2. However, the closing mechanism 100 can also be operably integrated in a like manner on the left side of the drawer 12, or both sides of the drawer 12.

Figure 3:
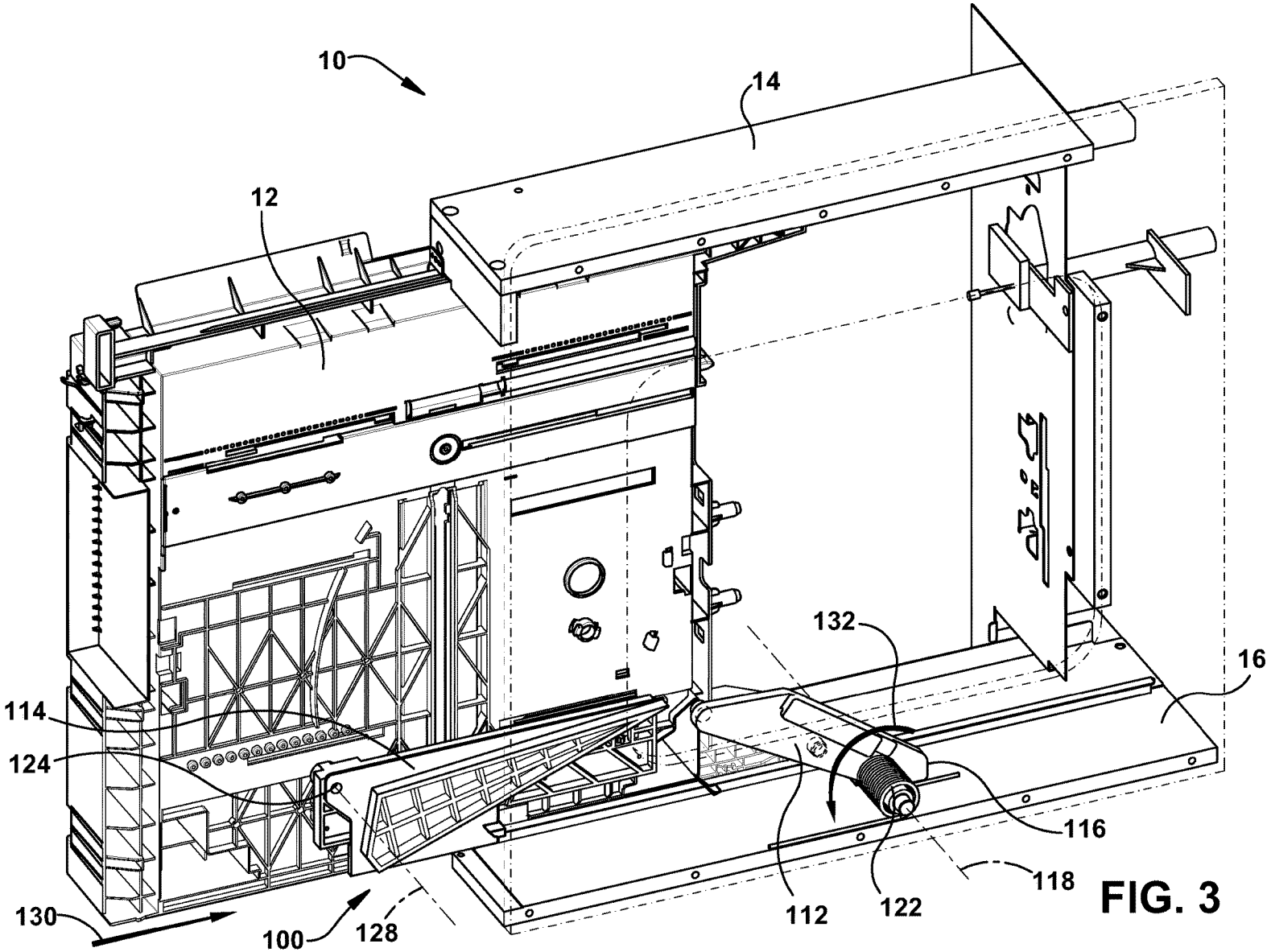
FIG. 3 is an example embodiment is an example embodiment of a portion of a document processing device showing an example closing mechanism.
Figure 4:
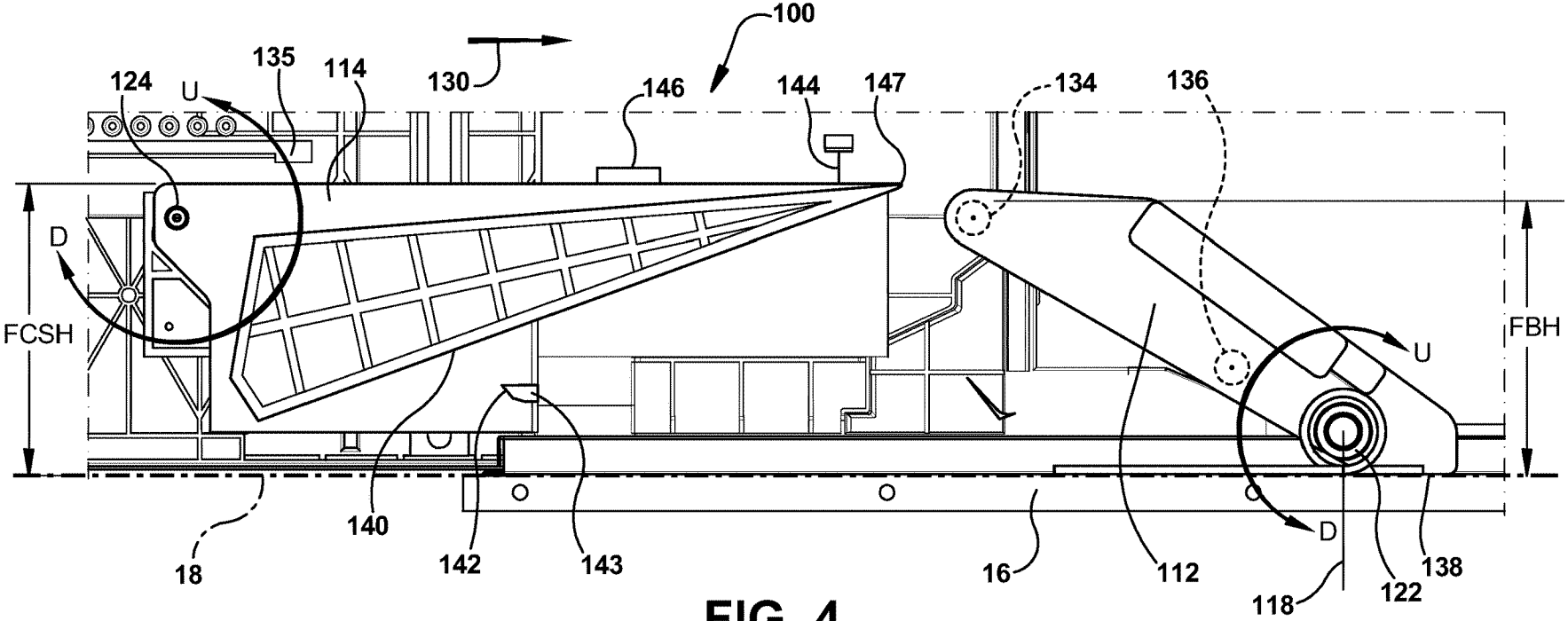
FIG. 4 is a side view of example embodiment of closing mechanism.

Turning now to FIG. 3, illustrated is another view of the document processing device 10 shown in FIG. 2, but with a portion of the chassis 14 removed from view to better illustrate the placement of certain components of the closing mechanism 100, as well as the relationship of these components to the drawer 12 and the chassis 14. A portion of the chassis 14 is suitably a lower chassis member 16, on which a portion of the closing mechanism 100 is suitably fixedly positioned, and an upper surface of which can define an imaginary chassis plane 18, as shown in FIG. 4. The imaginary chassis plane 18 is used as a reference for other portions of the closing mechanism 100. The term chassis plane, however, is not intended to indicate an actual flat, planar, surface, but rather as a reference on a portion of the chassis that is suitably a generally horizontally disposed surface, and which is convenient for disclosure of other components of the closing mechanism 100 and its workings. As used herein, terms such as "horizontal," "vertical," "up," "down," "upwardly," and "downwardly," and the like are used for descriptive purposes for a better understanding in relation to the FIGURES used herein. Thus these terms and others of position, direction, and orientation are not to be limiting to an the closing mechanism 100, which could, for example, be adapted for use in an inverted position relative to what is disclosed.

Figure 6:
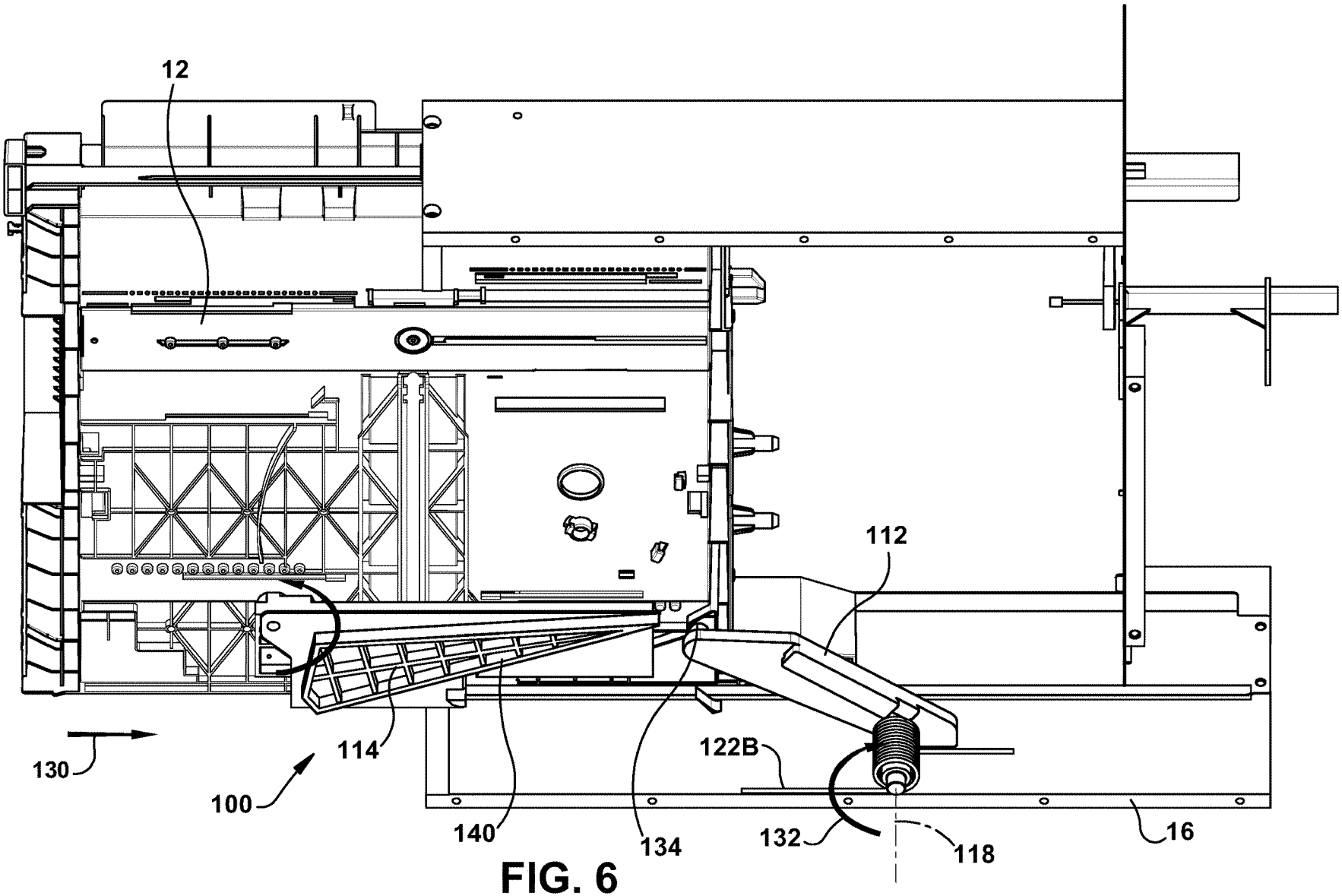
FIG. 6 is a perspective view of example embodiment of closing mechanism.

The closing mechanism 100 can include a lever arm 112 and a cam plate 114 that operate together to facilitate a low resistance, soft close and a relatively low resistance opening of the drawer 12. Both or either of the lever arm 112 or the cam plate 114 is suitably made of a rigid material, such as plastic, metal, and composite. The lever arm 112 is suitably joined to the chassis, for example to the lower chassis member 16, and is suitably pivotable at a proximal portion 116 about a lever arm pivot axis 118. In an embodiment, the lever arm 112 is suitably mounted on the lower chassis member 16 by a lever arm bracket 120, as shown in FIG. 6. An energy storage element 122, which is suitably a spring, including a torsion spring as shown, is suitably operatively connected to the lever arm 112 and/or the lever arm bracket 120. The energy storage element 122 stores potential energy when the lever arm is pivoted about the lever arm pivot axis 118 such that the distal end moves toward the lower chassis member 16, for example, in the direction shown by arrow 132. As disclosed more fully below, the lever arm 112 has a plurality of bearing surfaces (not shown in FIG. 3) that cooperate with the cam plate during a drawer closing sequence when the drawer is urged closed in the direction of the arrow 130. In general, as disclosed herein, the closing mechanism 100 operates as the drawer 12 is in motion and the chassis 14 is stationary.

Continuing to refer to FIG. 3, the cam plate 114 is suitably mounted to a portion of the drawer, such as a right side portion as indicated in FIG. 3, and is suitably pivotable at a proximal portion 124 about a cam plate pivot axis 128. As disclosed more fully below, the cam plate 114 has a plurality of cam surfaces that that cooperate with the lever arm 112 during a drawer closing sequence when the drawer is urged closed in the direction of the arrow 130.

Referring now to FIG. 4, an embodiment of the closing mechanism 100 is shown in more detail. The lever arm 112 can pivot about the lever arm pivot axis 118 down (D) toward the lower chassis member 16 or up (U) away from the lower chassis member 16, as indicated by arrow 132. The energy storage element 122 can bias the lever arm in a fully up (clockwise as shown in FIG. 4) to a first lever arm limit position, with further rotation being prevented by a proximal extension 138 of the lever arm that contacts the lower chassis member 16. The lever arm 112 can include a first bearing surface 134 and a second bearing surface 136, which can extend from the drawer-side of the lever arm 112. In an embodiment, one or both bearing surfaces can comprise a roller bearing joined to and extending from the drawer-side of the lever arm 112, as indicated in more detail in FIGS. 5 and 6. When the lever arm 112 is in a fully upwardly biased first lever arm limit position, as shown in FIG. 4, the first bearing surface 134 is suitably a distance denoted as the first bearing height FBH above the imaginary chassis plane 18 (which is suitably measured between the upper surface of the lower chassis member 16 and an upper tangential surface of a roller bearing, as shown).

The cam plate 114 can pivot about the cam plate pivot axis 128 down (D) toward the lower chassis member 16 or up (U) away from the lower chassis member 16, as indicated by arrow 135. A cam plate biasing spring 144 can bias the cam plate 114 in a fully up (counter clockwise as shown in FIG. 4) first cam limit position, with further rotation being prevented by a cam stop tab 147 that can, for example, extend from the drawer 12. The cam plate 114 can have extending from a side thereof a first cam surface 140 and a second cam surface 142. The first cam surface 140 is suitably relatively longer than the second cam surface 142. When the cam plate 114 is in a fully upwardly biased first cam limit position, as shown in FIG. 4, at least a portion of the first cam surface 140, which is suitably the first cam surface distal end 146, is suitably a distance denoted a first cam surface height FCSH above the imaginary chassis plane 18 (which is suitably the upper surface of the lower chassis member 16). As will be understood from the description herein, in an example the distance FCSH is suitably greater than the distance FBH.

Figure 5:
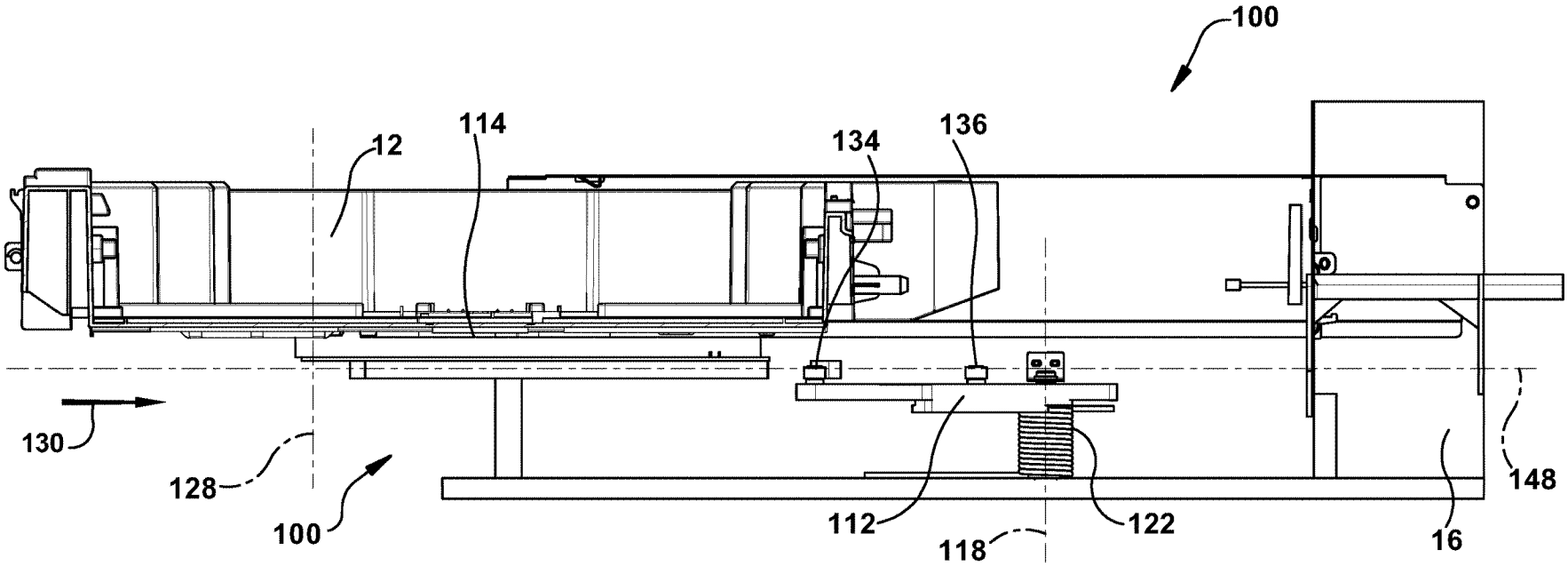
FIG. 5 is a top view of example embodiment of closing mechanism.

Turning now to FIG. 5, illustrated is a plan view of the embodiment of the closing mechanism 100 shown in FIG. 4. At least a portion of the cam plate 114, including the first cam surface 140 and the second cam surface 142 (neither visible in the view of FIG. 5) is configured to be positioned in the same plane as the first bearing surface 134 and the second bearing surface 136, such as the imaginary plane 148. Thus, as can be understood, when the drawer 12 is closed in the direction of the arrow 130, the first cam surface 140 will be urged into contact with the first bearing surface 134, thereby forcing the lever arm 112 in a downward motion toward the lower chassis member 16 while simultaneously storing energy in the energy storage element 122. Likewise, as described more fully below, with further movement in the direction of arrow 130, the second bearing surface 136 will be urged by the release of energy in the energy storage element 122 against the second cam surface 142, to pull the drawer into a fully closed position.

With reference to FIGS. 6-14, the operation of the closing mechanism 100 to facilitate a low resistance soft close and a relatively low resistance opening of the drawer 12 is illustrated in a step-by-step sequence. As depicted in FIG. 6, the drawer 12 is open a sufficient distance such that the both the lever arm 112 and the cam plate 114 are in their respective first limit position states in which each are fully rotated upwardly and non-contacting to each other. That is, no portion of the cam plate 114 is in direct contact with the any portion of the lever arm 112. The drawer 12 with the cam plate 114 attached is suitably urged by a user toward a closed position by moving it in the direction of the arrow 130 toward the lever arm 112, which is fixed to the lower chassis member 16.

Figure 7:
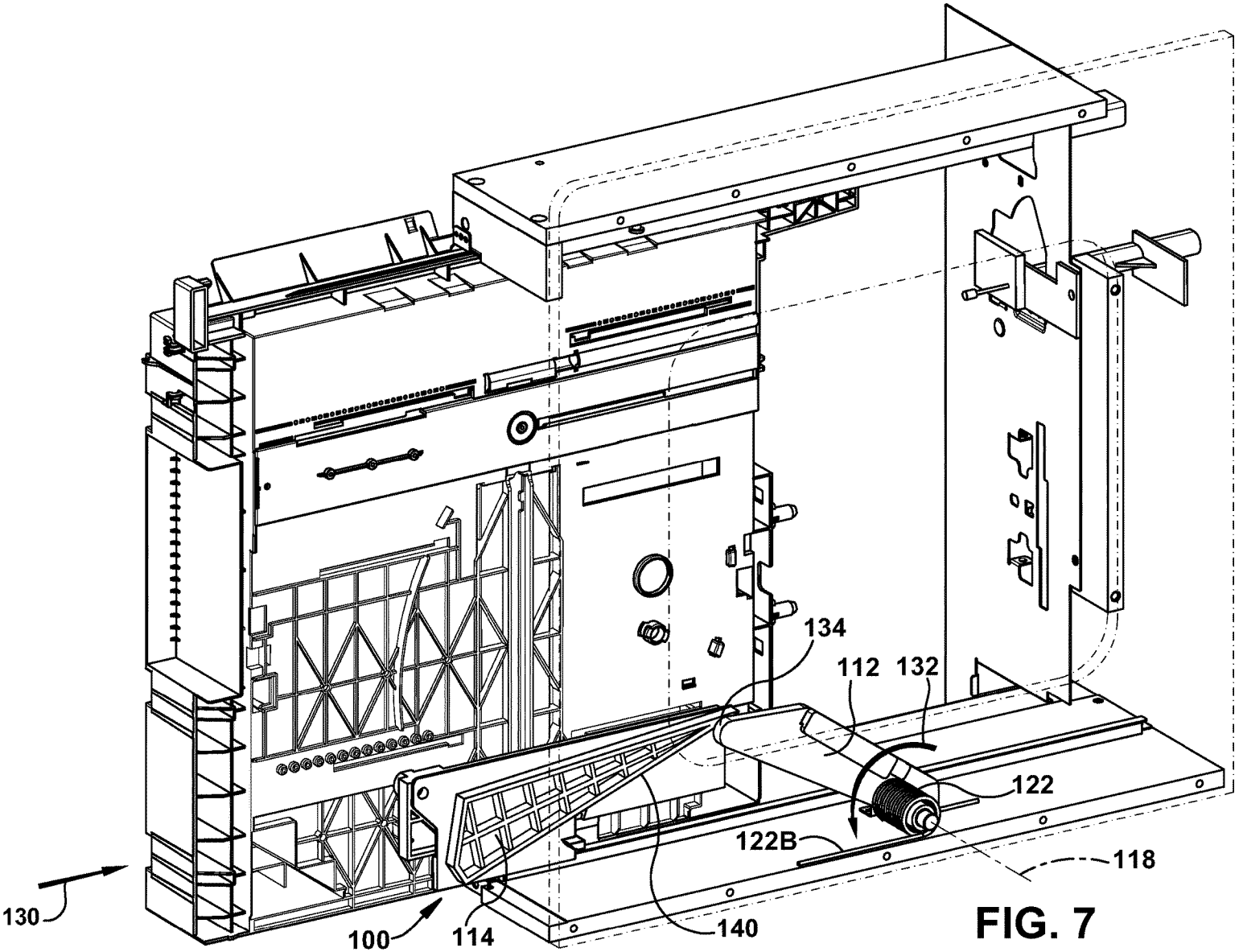
FIG. 7 is a perspective view of example embodiment of closing mechanism.

Referring now to FIG. 7, the drawer 12 is urged closed in the direction of the arrow 130 a sufficient distance such that the first bearing surface 134, makes contact with the first cam surface 140. As the drawer 12 is urged further into a closed position, the angled slope of the first cam surface 140 forces the lever arm downwardly as it pivots about lever arm pivot axis 118, as indicated by the arrow 132. As the lever arm 112 pivots, energy is stored in the energy storage element 122, which in the illustrated embodiment is a torsion spring which is suitably a coil spring operatively connected such that a first extended end 122A of the spring coil is fixed to the lever arm and a second extended end 122B of the spring coil is fixed to the chassis 14, as shown in more detail in FIG. 11.

Figure 8:
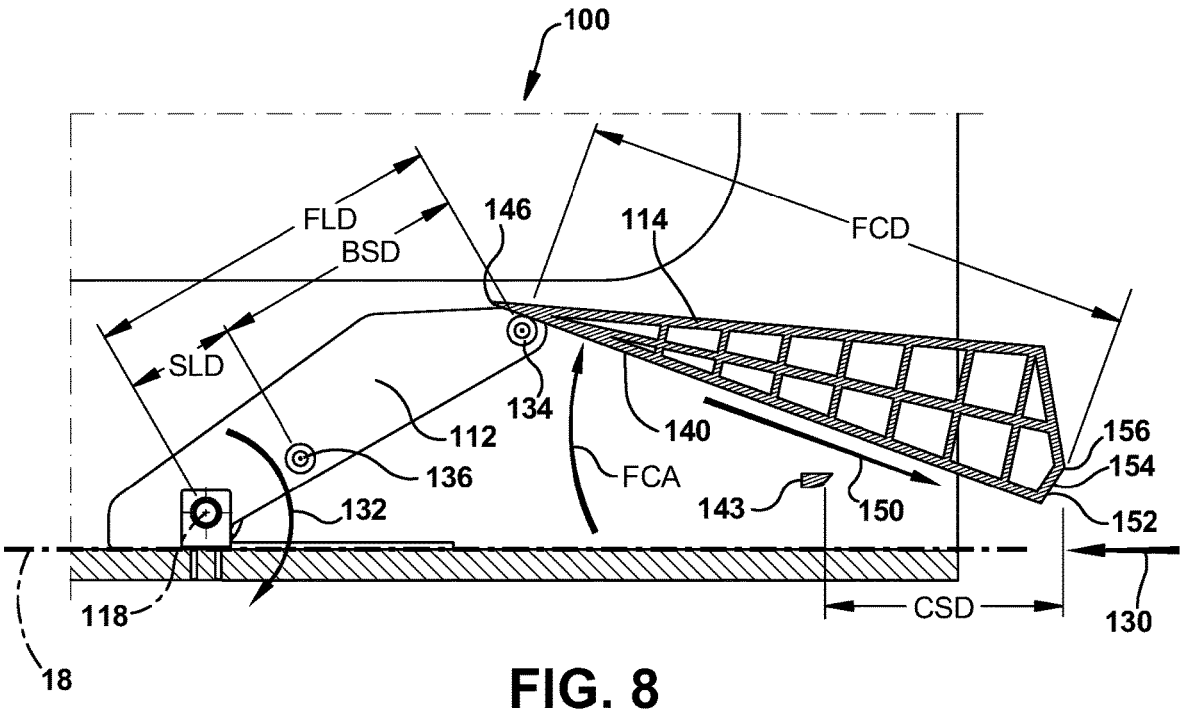
FIG. 8 is a schematic side view of example embodiment of closing mechanism.
Figure 9:
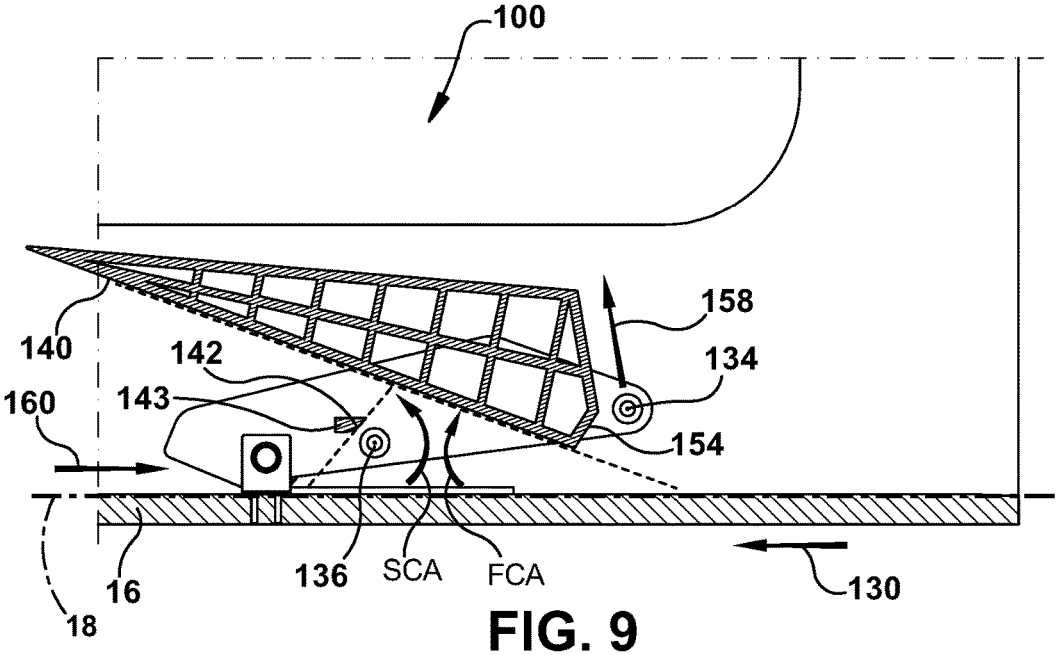
FIG. 9 is a schematic side view of a portion of an example embodiment of closing mechanism.

Turning now to FIGS. 8 and 9, illustrated is a schematic view of the operation of the closing mechanism 100 in the state described above in FIG. 7, but viewed from the drawer side, so to speak, to better show certain operative shapes, placements, and relationships between components of the closing mechanism 100. In FIG. 8, the cam plate 114, which is connected to the drawer 12 (not shown), is moved in the direction of the arrow 130 when the drawer is urged closed. As in FIG. 7, when the drawer is urged closed, the first cam surface 140 of the cam plate 114 contacts the first bearing surface 134, which in turn forces the lever arm downwardly, as indicated by the arrow 132. Further as described above and more fully evident in FIG. 9, the first cam surface inclines at an angle, termed a first cam angle FCA, to the lower chassis member 16, and more particularly to the imaginary chassis plane 18. The first cam angle FCA is relatively smaller than a second cam angle SCA, described in FIG. 9. Additionally, the first cam surface is relatively long (relative to the second cam surface), extending a first cam distance FCD sufficient, in combination with the first cam angle FCA to rotate the lever arm 112 to a second limit position in which the second bearing surface 136 can pass under the second cam tab 143. That is, as the first bearing surface 134 is urged in contact with the first cam surface 140 from at or near the first cam surface distal end 146 in the direction of the arrow 150 toward the first cam surface proximal end 152, the lever arm 112 is forced to rotate downwardly almost fully, and the second cam tab 143 is presented and over the second bearing surface.

As can be understood from the description herein, certain relative dimensions of components, component placement and orientation can contribute to the working of the closing mechanism 100. For example, the first bearing surface is suitably disposed at a first bearing lever arm distance FLD that is greater than the second bearing arm lever distance SLD, such that a lower force is required on the first bearing surface to deliver a torque that is suitably returned with a higher force by the second bearing surface 136 on the second cam surface 142. Additionally, the distance between the first bearing surface 134 and the second bearing surface 136, BSD, is suitably substantially equal to the distance between the beginning of the second cam surface 142 and the first cam surface proximal end 152, CSD. As described below, and as shown in FIG. 9, as the first bearing surface 134 leaves contact with a cam surface, the second bearing surface 136 makes contact with the second cam surface 142. Further, in an example embodiment, as indicated in FIG. 9, the second cam surface angle SCA is suitably relatively greater than the first cam surface angle FCA. It is noted that due to the various shapes and sizes of bearing surfaces, as well as the various shapes and sizes of cam surfaces, the illustrated measurement lines showing distances of FLD, SLD, BSD, FCD, and CSD are not intended to be exact, but are representative of various dimensional principles that is suitably employed according to the apparatus, system and methods disclosed herein.

Continuing reference to FIG. 8, with continuing movement of the drawer in the direction of arrow 130, the lever arm 112 rotates downwardly as indicated by the arrow 132 about lever arm pivot axis 118 until the first bearing surface reaches the first cam surface proximal end 152, and, optionally, to a third cam surface 154 that continues to constrain the lever arm 112 by contact with the first bearing surface 134 as it rounds the first cam surface proximal end 152 and rides at an upward angle on third cam surface 154, which ends at third cam surface terminal 156. Whether at first cam surface proximal end 152 or at the end of third cam surface terminal 156, movement of the drawer in the direction of arrow 130 eventually results in the stage of the closing sequence at which the first bearing surface 134 is no longer in contact with the first cam surface 140 or the third cam surface 154, and the energy stored in the energy storage element 122 is no longer constrained from release by the first bearing surface 134 in contact with a cam surface.

As can be understood by further examination of FIGS. 8 and 9, as well as the description of the drawer closing sequence, the first bearing surface 134 and the second bearing surface 136 is suitably separated by the bearing separation distance BSD. Further, the beginning of the second cam surface 142 (which is angled in relation to the lower chassis member 16, and more particularly to the imaginary chassis plane 18) and the first cam surface proximal end 152 or at the end of third cam surface terminal 156 (as depicted in FIG. 8) is suitably separated by a cam separation distance CSD. In an embodiment, the bearing separation distance BSD and the cam separation distance CSD is suitably substantially equal, such that as the first bearing surface 134 disengages from a cam surface, the second bearing surface 136, having, in effect, "passed under" the second cam tab 143 and possibly a portion of the second cam surface 142, contacts the second cam surface 142, and urged by the torque supplied by the energy released from the energy storage element 122, moves up the second cam surface 142, thereby further urging the drawer to move in the direction of the arrow 130. The action of the torque-induced force of the second bearing surface 136 on the second cam surface 142 provides for positive, controlled, soft-closing of the drawer 12 to a closed position.

The operation of the closing mechanism 100 is further illustrated with reference to FIG. 9, which shows a portion of the depiction of FIG. 8 in greater detail. As discussed above, the first cam surface 140 is oriented at the first cam angle FCA with reference to the imaginary chassis plane 18, which for purposes of description is suitably described as a "positive" angle less than 90 degrees being measured clockwise (as shown in FIG. 9) from the imaginary chassis plane 18. The second cam surface is oriented at the second cam angle SCA with reference to the imaginary chassis plane 18, which for purposes of description is suitably described as a "negative" angle less than 90 degrees being measured counter clockwise (as shown in FIG. 9) from the imaginary chassis plane 18. That is, regardless of descriptors such as "positive" and "negative," both the first cam angle FCA and the second cam angle SCA each define acute angles with reference to the imaginary chassis plane 18, but in opposite inclinations. Thus, as can be understood by an examination of FIG. 9, as the drawer 12 moves in the direction of the arrow 130, the first bearing surface 134 and the second bearing surface 136 "move" in relative terms in the direction of arrow 160. Due to the downward pivot of the lever arm 112, second bearing surface 136 "moves" under the second cam tab 143. At the stage of the closing sequence that first bearing surface 134 leaves contact with the first cam surface 140 or the third cam surface 154, the lever arm 112, no longer constrained against the energy storing force of the first bearing surface movement, can "spring back" with a torque, providing force to the lever arm 112 toward an upward position in the direction of arrow 158. However, because the second bearing surface 136 is positioned at the second cam surface 142, the release of energy stored in the energy storage element 122 supplies a force of the second bearing surface 136 against the angled second cam surface 142, thereby providing a force to move the drawer 12 further in the direction of the arrow 130, and to a closed position.

Figure 10:
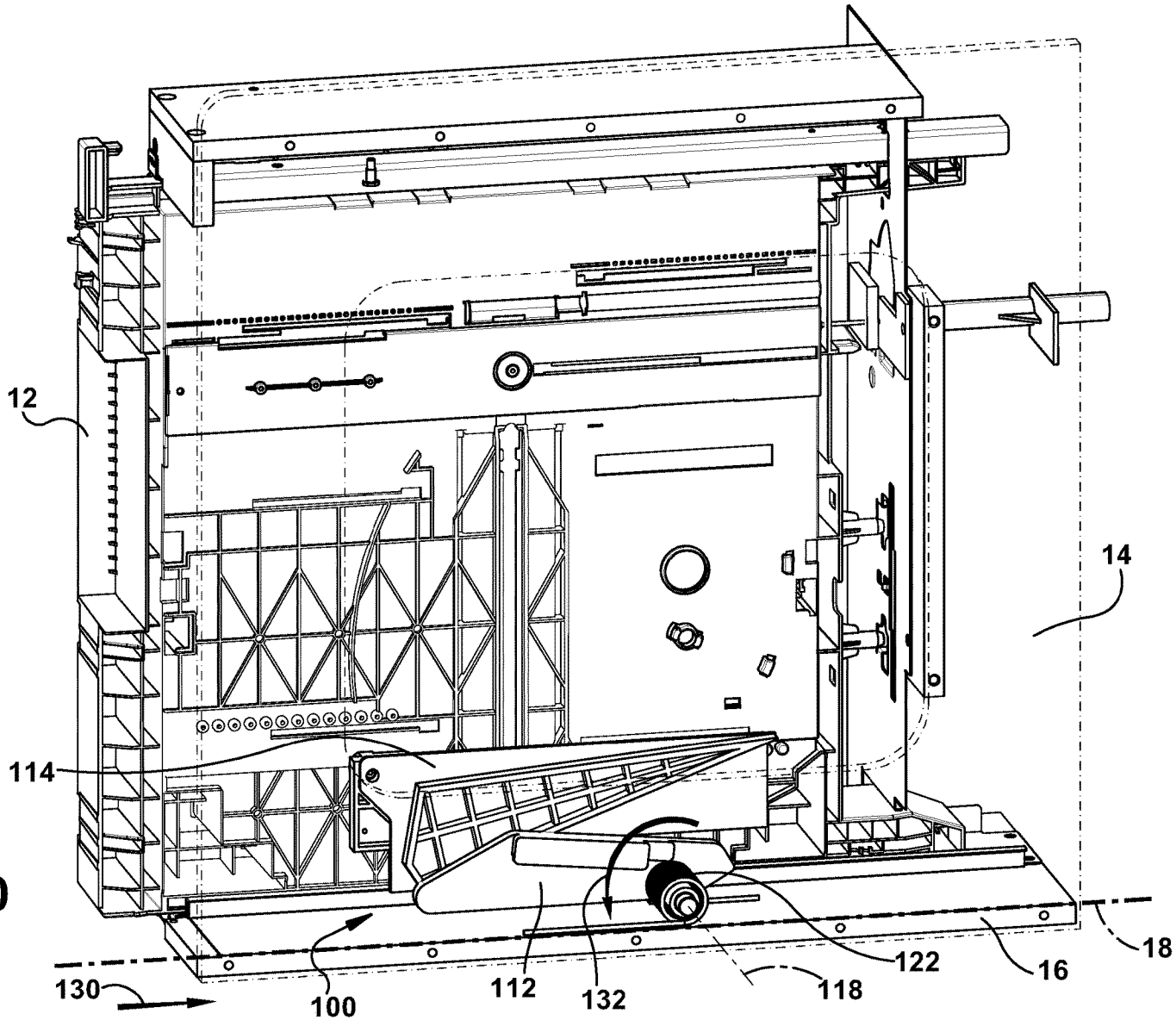
FIG. 10 is a perspective view of example embodiment of closing mechanism.
Figure 11:
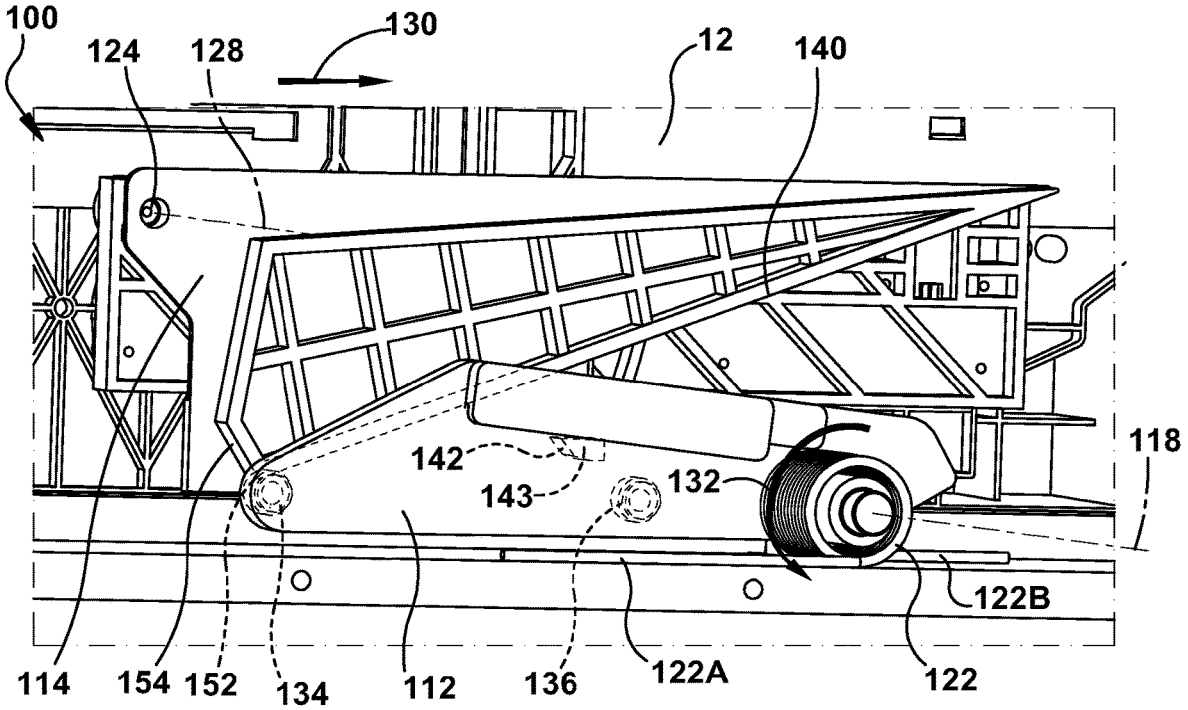
FIG. 11 is a perspective view of example embodiment of closing mechanism.

With the above description in mind, reference to the following FIGURES illustrates the closing sequence further. Referring now to FIGS. 10 and 11, the semi-transparent view of the closing mechanism 100 shows the stage of the sequence in which the drawer 12 has been moved in the direction of the arrow 130 a distance sufficient to rotate the lever arm 112 in the direction of arrow 132 as the first bearing surface 134 reaches first cam surface proximal end 152.

Figure 12:
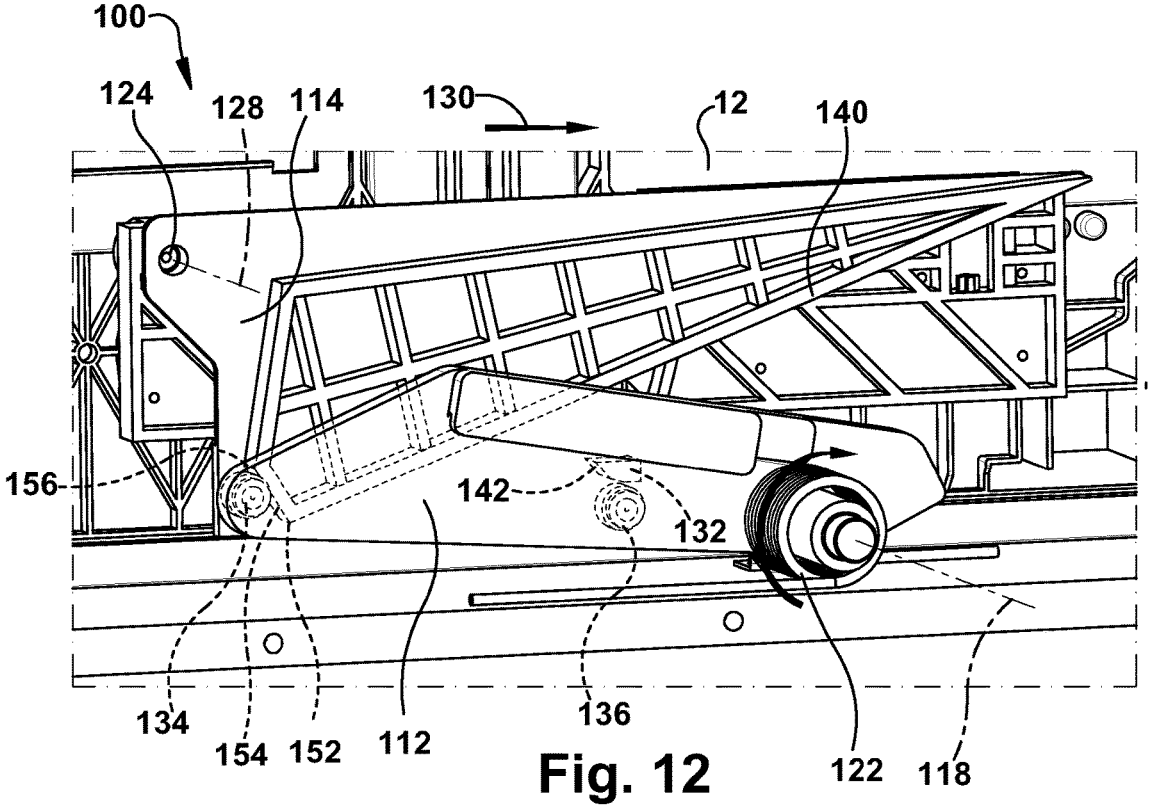
FIG. 12 is a perspective view of example embodiment of closing mechanism.

Referring now to FIG. 12, illustrated is a view of the closing mechanism 100 at the stage of the closing sequence in which the drawer 12 has been moved in the direction of the arrow 130 a distance sufficient the first bearing surface 134 has moved off the first cam surface proximal end 152 and onto the third cam surface 154, and, due to the orientation of the angled third bearing surface, permits some energy release from the energy storage element 122 to rotate the lever arm 112 upwardly, as indicated by the arrow 132, but constrained by the third cam surface 154 and/or the second cam tab 143. The second bearing surface 136 is positioned under the second cam tab 143.

Figure 13:
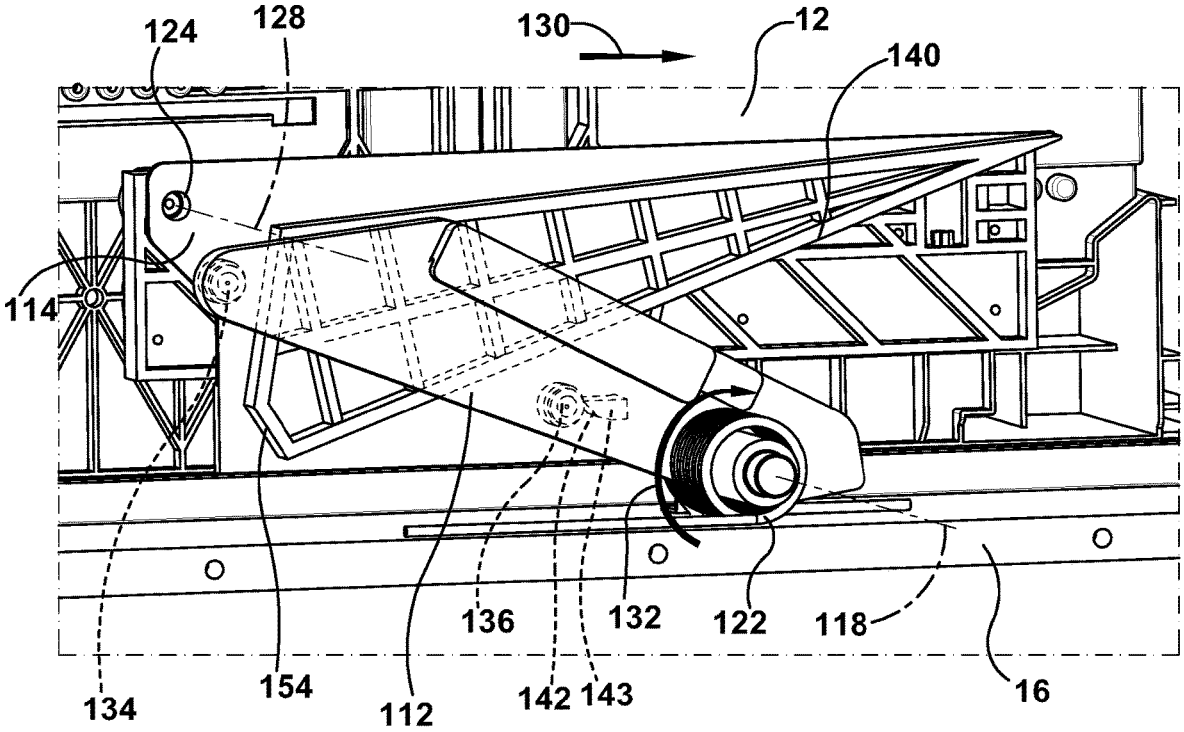
FIG. 13 is a perspective view of example embodiment of closing mechanism.

Referring now to FIG. 13, illustrated is a view of the closing mechanism 100 showing the stage of the sequence in which the drawer 12 has been moved in the direction of the arrow 130 a distance sufficient that the first bearing surface 134 has moved off the proximal end of third cam surface 154 and is no longer in contact with any cam surfaces. At this stage, the energy stored in the energy storage element 122 provides a torque in the direction of arrow 132 such that second bearing surface 136 is urged into contact with the angled second cam surface 142, providing a force to further move the drawer in the direction of arrow 130, and into a closed position. In an embodiment, at this stage of the sequence a latch (not shown) can latch the drawer 12 securely closed.

Figure 14:
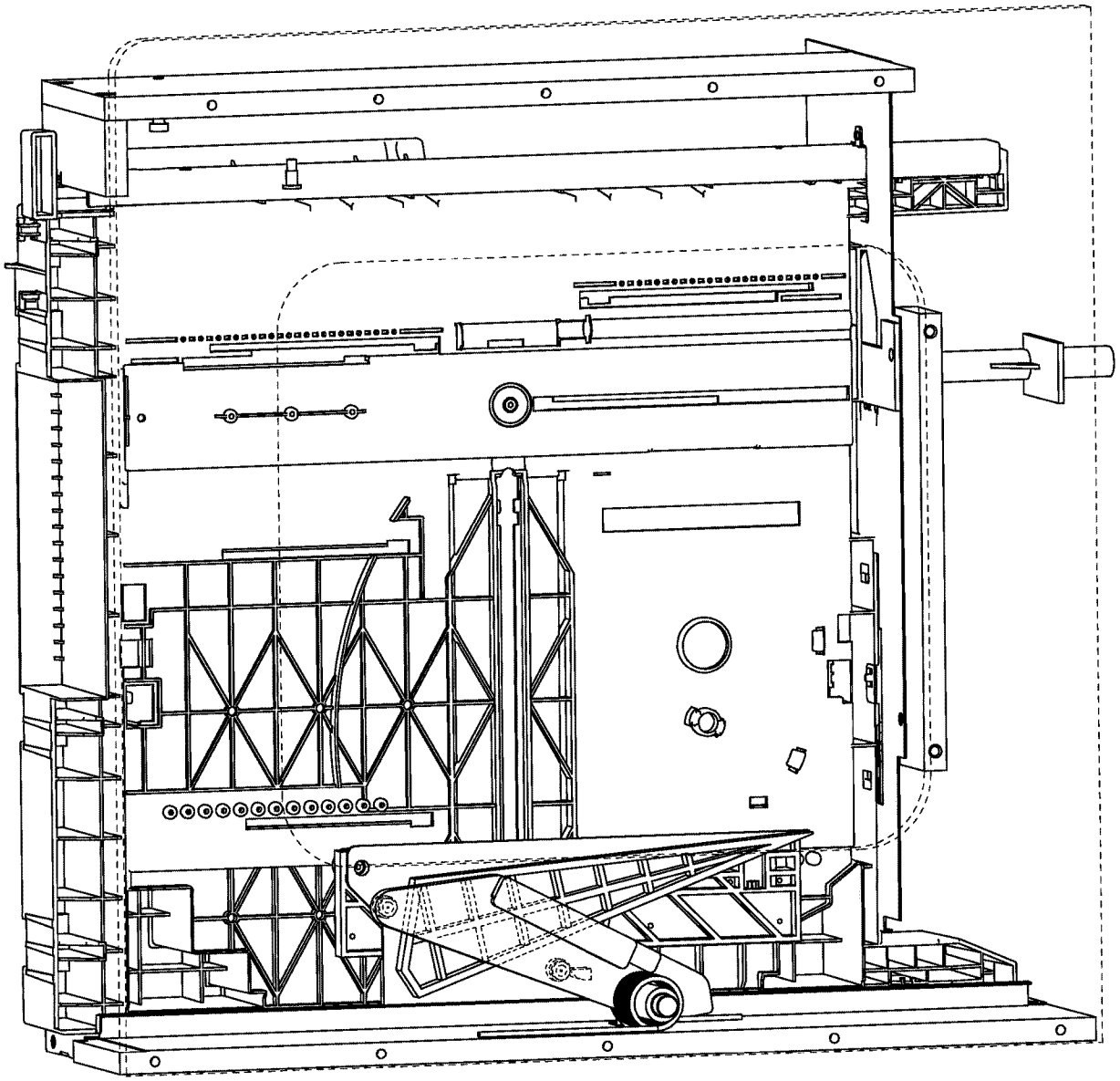
FIG. 14 is a perspective view of example embodiment of closing mechanism.

This above description describes certain example stages of a closing sequence for the drawer 12. Of course, the closing of a drawer is not performed in discrete stages, but in a constant, fluid motion, with the closing mechanism 100 also operating in a constant, fluid motion during the closing of the drawer. The first bearing surface 134 and/or the second bearing surface 136 is suitably a roller bearing, thus providing for smooth, minimal friction between the first cam surface 140 and/or the second cam surface 142, respectively. The benefits of the closing mechanism 100 is suitably understood by a consideration of the relative dimensions and characteristics of the various components and the mechanical advantages derived from them during use. Reference again to FIG. 8 will aid in understanding the benefits and advantages, described herein. For example, during the motion of a user closing the drawer in the direction of the arrow 130 (as described above), the first bearing surface 134 is in contact with the first cam surface 140 and the user's force supplies the energy to urge the lever arm down, thereby storing energy in the energy storage element 122. Because the first lever arm distance FLD distance from the lever arm pivot axis 118 to the first bearing surface 134 is relatively long, and the first cam distance FCD is relatively long, and the first cam surface angle FCA is relatively shallow, the user experiences little force resistance during the motion of pushing the drawer into place, while simultaneously energizing the energy storage element 122 by suppling torque-induced potential energy. However, because the second lever arm distance SLD from the lever arm pivot axis 118 to the second bearing surface 136 is relatively short, the force supplied by the torque of the released potential energy on the second cam surface 142 is suitably significantly greater than the force of the energizing torque, and sufficient to "automatically" pull the drawer into a secure, latched, closed position. Thus, the user experiences minimal force resistance closing the door to an almost closed position, at which time the closing mechanism 100 smoothly, securely and relatively forcefully closes the door completely, as depicted in FIG. 14.

Thus, in an embodiment, the closing mechanism 100 is suitably described in terms of a drawer 12 that is translatably, for example, slidingly or rollingly, mounted on the chassis 14 at the imaginary chassis plane 18 and translatable from a first open state to a second intermediate state and to a third closed state. Upon translating the drawer with a first force from the first open state to the second intermediate state the first cam surface engages the first bearing surface to cause the lever arm to pivot about the lever arm pivot axis and store potential energy in the energy storage member. Upon translating the drawer with the first force from the second intermediate state the first bearing surface disengages the first cam surface and the second cam engages the second bearing surface to exert a second force from the stored potential energy to urge the drawer to the third closed state.

Because the force of the first bearing surface 134 on the first cam surface 140 can impart a generally upward force on the drawer 12, in an embodiment, a roller or other low resistance element, such as a slide member, is suitably disposed on the drawer, such as at the top thereof, to reduce slide friction of the top of the door with the chassis 14.

Figure 15:
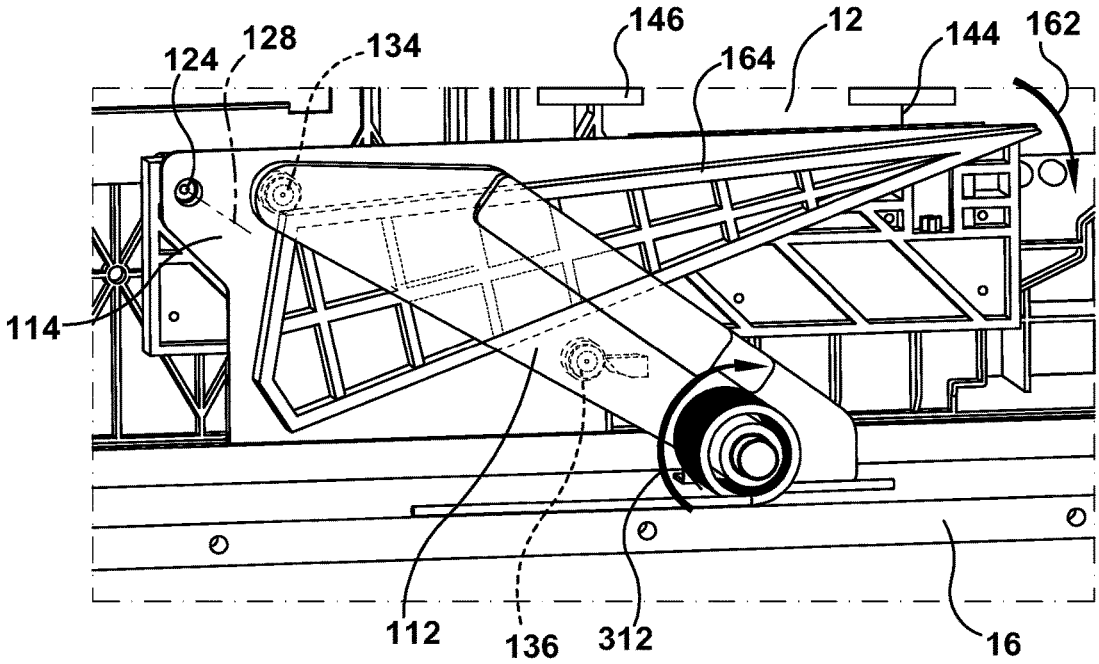
FIG. 15 is a perspective view of example embodiment of closing mechanism.
Figure 16:
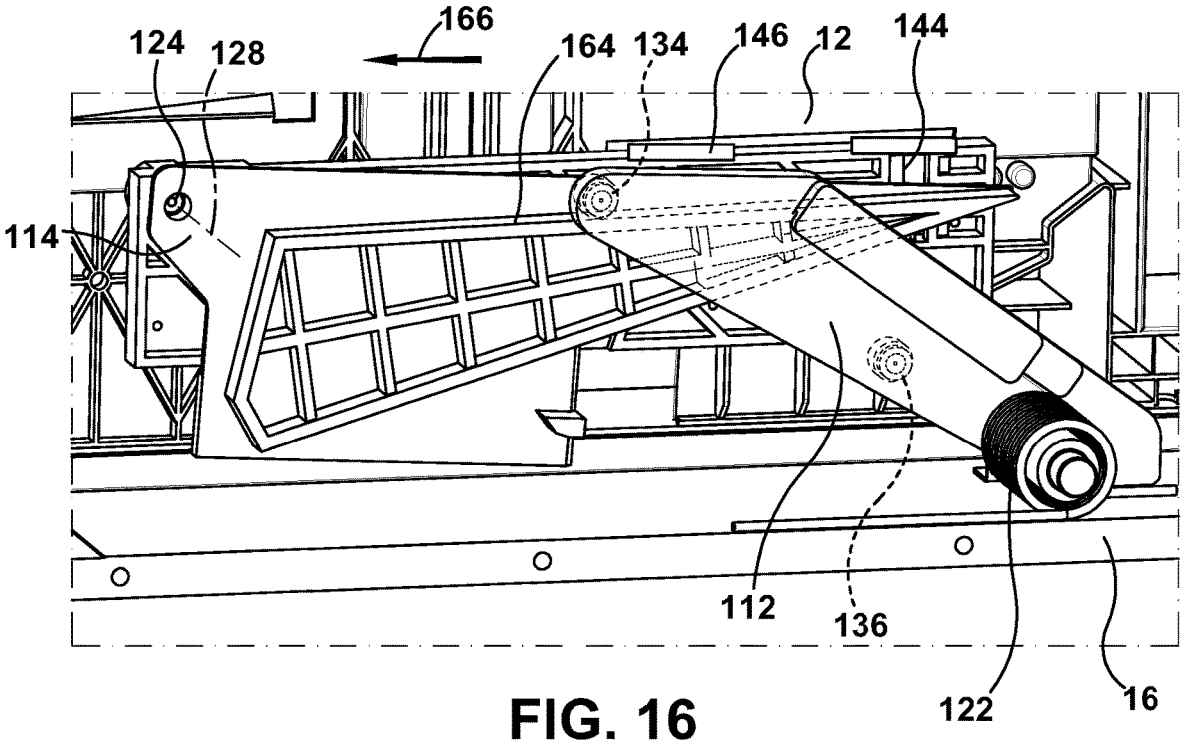
FIG. 16 is a perspective view of example embodiment of closing mechanism.

An example drawer 12 opening sequence is depicted in FIGS. 15 and 16. In an embodiment a latch (not shown) that latches the drawer 12 closed is suitably released by a user desiring to open the drawer 12. As depicted in FIG. 15, as part of the opening sequence, the cam plate 114 is suitably rotated downwardly about the cam plate pivot axis 128 in the direction of the arrow 162, against the tension of the cam plate biasing spring 144, and away from the cam stop tab 147. This motion permits the second bearing surface 136 to come clear of the second cam surface 142 while the first bearing surface 134 comes clear of an upper cam surface 164, and the energy storage element 122 returns the lever arm 112 in the direction of the arrow 132 until it reaches its upper limit. Rotating the cam plate downwardly is suitably achieved by mechanical means connected to a drawer latching device, such that upon unlatching the drawer for opening, the cam plate is rotated downwardly a sufficient distance to release the second bearing surface from the second cam surface. As shown in FIG. 16, as the drawer 12 is opened, i.e., moved in the direction of the arrow 166, the first bearing surface 134 can ride with minimal contact and virtually no resistance on the upper cam surface 164, while the second bearing surface is free on any cam surfaces. As can be understood, during opening, the user experiences virtually no resistance from the closing mechanism 100.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the spirit and scope of the inventions.

What is claimed is:

1. A door closing mechanism, comprising a lever arm joined to a fixed surface at a proximal portion and pivotable about a lever arm pivot axis from a first lever arm limit state to a second lever arm limit state, the lever arm comprising a first bearing surface at a first lever arm distance and a second bearing surface at a second lever arm distance, wherein one of the first bearing surface and the second bearing surface is a roller bearing;

an energy storage element operably integrated with the lever arm;

a cam plate being translatable toward the lever arm from a first cam position to a second cam position and pivotable about a cam plate pivot axis from a first cam limit state at the first cam position, the cam plate comprising a first cam surface and a second cam surface, the first cam surface being oriented at a positive angle relative to the fixed surface and aligned generally co-planar with the first bearing surface, the second cam surface being oriented at a negative angle relative to the fixed surface and aligned generally co-planar with the second bearing surface; and wherein, the energy storage element has a first potential energy state at the first cam position and a second, higher potential energy state at the second cam position.

2. The door closing mechanism of claim 1, wherein the first bearing surface and the second bearing surface are linearly aligned with the lever arm pivot axis.

3. The door closing mechanism of claim 1, wherein the energy storage element is a spring.

4. The door closing mechanism of claim 1, wherein the energy storage element is a torsion spring having a torsion spring axis generally parallel to the lever arm pivot axis.

5. The door closing mechanism of claim 1, wherein at the second cam position the second bearing surface is in contact with the second cam surface.

6. The door closing mechanism of claim 1, wherein the first cam surface is generally linear.

7. A door closing mechanism, comprising a fixed chassis defining a chassis plane;

a lever arm joined to the fixed chassis and pivotable at a proximal portion about a lever arm pivot axis from a first lever arm limit state to a second lever arm limit state, the lever arm comprising a first bearing surface at a first lever arm distance and a second bearing surface at a second lever arm distance, the first bearing surface being disposed a bearing surface distance from the second bearing surface;

an energy storage element operably integrated with the lever arm;

a cam plate being translatable toward the lever arm from a first cam position to a second cam position and pivotable about a cam plate pivot axis from a first cam limit state to a second cam limit state, the cam plate comprising a first cam surface and a second cam surface, the first cam surface being oriented at a positive angle relative to the chassis plane and aligned generally co-planar with the first bearing surface, the second cam surface being oriented at a negative angle relative to the chassis plane and aligned generally co-planar with the second bearing surface;

wherein the bearing surface distance is substantially equal to a cam surface distance separating a distal end of the first cam surface and a proximal end of the second cam surface; and wherein the energy storage element is a torsion spring having a torsion spring axis generally parallel to the lever arm pivot axis.

8. The door closing mechanism of claim 7, wherein the first bearing surface and the second bearing surface are linearly aligned with the lever arm pivot axis.

9. The door closing mechanism of claim 7, wherein one of the first bearing surface and the second bearing surface is a roller bearing.

10. The door closing mechanism of claim 7, wherein the energy storage element is a spring.

11. The door closing mechanism of claim 7, wherein the first cam surface is generally linear.

12. The door closing mechanism of claim 7, wherein the energy storage element has a first potential energy state at the first cam position and a second, higher potential energy state at the second cam position.

13. A door closing apparatus for a document processing device, comprising a document processing device chassis defining a chassis plane;

a drawer translatably mounted on the document processing device chassis at the chassis plane and translatable from a first open state to a second intermediate state and to a third closed state;

a lever arm joined to the document processing device chassis and pivotable at a proximal portion about a lever arm pivot axis from a first lever arm limit state to a second lever arm limit state, the lever arm comprising a first bearing surface extending outwardly from the lever arm at a first lever arm distance and a second bearing surface extending outwardly from the lever arm at a second lever arm distance, the first bearing surface being disposed a bearing surface distance from the second bearing surface, wherein one of the first bearing surface and the second bearing surface is a roller bearing;

an energy storage element operably integrated with the lever arm;

a cam plate joined to the drawer and pivotable about a cam plate pivot axis from a first cam limit state to a second cam limit state, the cam plate comprising a first cam surface extending outwardly from the cam plate and a second cam surface extending outwardly from the cam plate, the first cam surface being oriented at a positive angle relative to the chassis plane and aligned generally co-planar with the first bearing surface, the second cam surface being oriented at a negative angle relative to the chassis plane and aligned generally co-planar with the second bearing surface; and wherein upon translating the drawer under a first force from the first open state to the second intermediate state the first cam surface engages the first bearing surface to cause the lever arm to pivot about the lever arm pivot axis and store energy in the energy storage element; and upon translating the drawer under the first force from the second intermediate state the first bearing surface disengages the first cam surface and the second bearing surface engages the second cam surface and exerts a second force released from the energy storage element to urge the drawer to the third closed state.

14. The door closing apparatus of claim 13, wherein the first bearing surface and the second bearing surface are linearly aligned with the lever arm pivot axis.

15. The door closing apparatus of claim 13, wherein the energy storage element is a spring.

16. The door closing apparatus of claim 13, wherein the energy storage element is a torsion spring having a torsion spring axis generally parallel to the lever arm pivot axis.

17. The door closing apparatus of claim 13, wherein the first cam surface is generally linear.

* * * * *